US011703805B2

(12) United States Patent
Saglini

(10) Patent No.: US 11,703,805 B2
(45) Date of Patent: Jul. 18, 2023

(54) TIMEPIECE MOBILE FOR A SEMI-INSTANTANEOUS JUMP MECHANISM

(71) Applicant: ETA SA MANUFACTURE HORLOGÈRE SUISSE, Grenchen (CH)

(72) Inventor: Julien Saglini, Bienne (CH)

(73) Assignee: ETA SA MANUFACTURE HORLOGÈRE SUISSE, Grenchen (CH)

( * ) Notice: Subject to any disclaimer, the term of this patent is extended or adjusted under 35 U.S.C. 154(b) by 487 days.

(21) Appl. No.: 17/020,185

(22) Filed: Sep. 14, 2020

(65) Prior Publication Data

US 2021/0157274 A1 May 27, 2021

(30) Foreign Application Priority Data

Nov. 27, 2019 (EP) ..... 19211701

(51) Int. Cl.
*G04B 19/253* (2006.01)
*G04B 11/00* (2006.01)

(52) U.S. Cl.
CPC ..... *G04B 19/25373* (2013.01); *G04B 11/006* (2013.01)

(58) Field of Classification Search
CPC ..... G04B 19/25373; G04B 19/253; G04B 19/24; G04B 11/006
See application file for complete search history.

(56) References Cited

U.S. PATENT DOCUMENTS 7,158,448 B1 * 1/2007 Gabathuler ..... G04B 19/25373 368/37
2012/0057434 A1 * 3/2012 Rudaz ..... G04B 19/2538 368/220

(Continued)

FOREIGN PATENT DOCUMENTS

CH 525 508 A 3/1972
CH 706 189 B1 9/2013

(Continued)

OTHER PUBLICATIONS

European Search Report for EP 19 21 1701 dated Jun. 3, 2020.
Communication dated Sep. 13, 2021 by the Chinese Patent Office in Chinese Application No. 202011362681.8.

*Primary Examiner* — Edwin A. Leon
*Assistant Examiner* — Jason M Collins
(74) *Attorney, Agent, or Firm* — Sughrue Mion, PLLC

(57) ABSTRACT

A timepiece mobile for a semi-instantaneous jump mechanism, including a stop member, an elastic return device, and a drive wheel including, around an axis a hub for guiding this movable stop member with respect to the drive wheel and including a disengageable stop finger movable between a wound position where its radial extension is maximum with respect to the axis, and an unwound position where its radial extension is minimal with respect to the axis, this stop finger being moved away from the axis by the elastic return device, and the stop member including a housing the walls of which are arranged to bearingly cooperate, during the winding of the elastic return device with a contact surface that this elastic return device includes to limit the value of the winding and to limit the deformation of the elastic return means to its elastic range only.

11 Claims, 4 Drawing Sheets

(56) References Cited

U.S. PATENT DOCUMENTS

| | | | | |
|---|---|---|---|---|
| 2013/0201801 | A1* | 8/2013 | Calabrese | G04B 27/00 368/34 |
| 2019/0129362 | A1* | 5/2019 | Fleury | G04B 19/2538 |

FOREIGN PATENT DOCUMENTS

| | | | |
|---|---|---|---|
| EP | 1 746 470 | A1 | 1/2007 |
| EP | 2 428 855 | A1 | 5/2019 |
| EP | 3 483 663 | A1 | 5/2019 |

* cited by examiner

TIMEPIECE MOBILE FOR A SEMI-INSTANTANEOUS JUMP MECHANISM

CROSS REFERENCE TO RELATED APPLICATIONS

This application is an Utility application, claiming priority of European Patent Application No. 19211701.8 of Nov. 27, 2019.

FIELD OF THE INVENTION

The invention relates to a timepiece mobile for a semi-instantaneous jump mechanism, said mobile including a stop member, an elastic return means, and a drive wheel which includes, around a pivot axis, a hub for guiding said stop member, which stop member is movable with respect to said drive wheel and includes at least one disengageable stop finger movable between a wound position wherein the radial extension of said stop finger is maximum with respect to said axis, and an unwound position wherein the radial extension of said stop finger is minimal with respect to said axis, said stop finger being subjected to the action of said elastic return means which tends to move it away from said axis.

The invention also relates to a semi-instantaneous jump timepiece display mechanism including such a mobile.

The invention also relates to a timepiece, in particular a watch, including at least one such semi-instantaneous jump timepiece display mechanism.

The invention relates to the field of timepiece display mechanisms, and in particular jumping displays, such as date mechanisms or the like.

BACKGROUND OF THE INVENTION

A semi-instantaneous jump timepiece mechanism often includes a spring including a finger, this spring including one or more coils, being kept wound for a fairly long time, and being relaxed during the jump, for example during the change of day for displaying a date. The deformation of such a spring is difficult to control.

Document CH525508A in the name of ERARD describes a device for driving a date indicator for a timepiece, which is constituted only by organs carried, respectively, by the hour wheel and by the minute wheel and pinion, the transmission ratio between the hour wheel and the minute wheel and pinion being defined so that there is a single coincidence in twenty-four hours causing the organ carried by the hour wheel to displace the organ carried by the minute wheel and pinion so that it drives the date indicator organ. The organ carried by the minute wheel and pinion is first displaced in order to wind a spring which is integral therewith until the moment when it is released and, under the action of said spring, projected forward in order to ensure an instantaneous jump of the date indicator disc. The organ carried by the hour wheel is designed so that it does not act during the functions in reverse direction of time setting.

SUMMARY OF THE INVENTION

The invention proposes to improve the control of the spring deformation of a disengageable drive system for a semi-instantaneous jump.

The inventive concept has the object of allowing angular winding which is more precise than in existing mechanisms, and to make any plastic deformation of the spring element almost impossible, so as to ensure its durability.

To this end, the invention relates to a timepiece mobile for a semi-instantaneous jump mechanism, according to claim 1.

The invention also relates to a semi-instantaneous jump timepiece display mechanism including such a mobile.

The invention also relates to a timepiece, in particular a watch, including at least one such semi-instantaneous jump timepiece display mechanism.

BRIEF DESCRIPTION OF THE DRAWINGS

Other features and advantages of the invention will become apparent upon reading the detailed description which follows, with reference to the appended drawings, where.

DETAILED DESCRIPTION OF THE PREFERRED EMBODIMENTS

Figure 1:
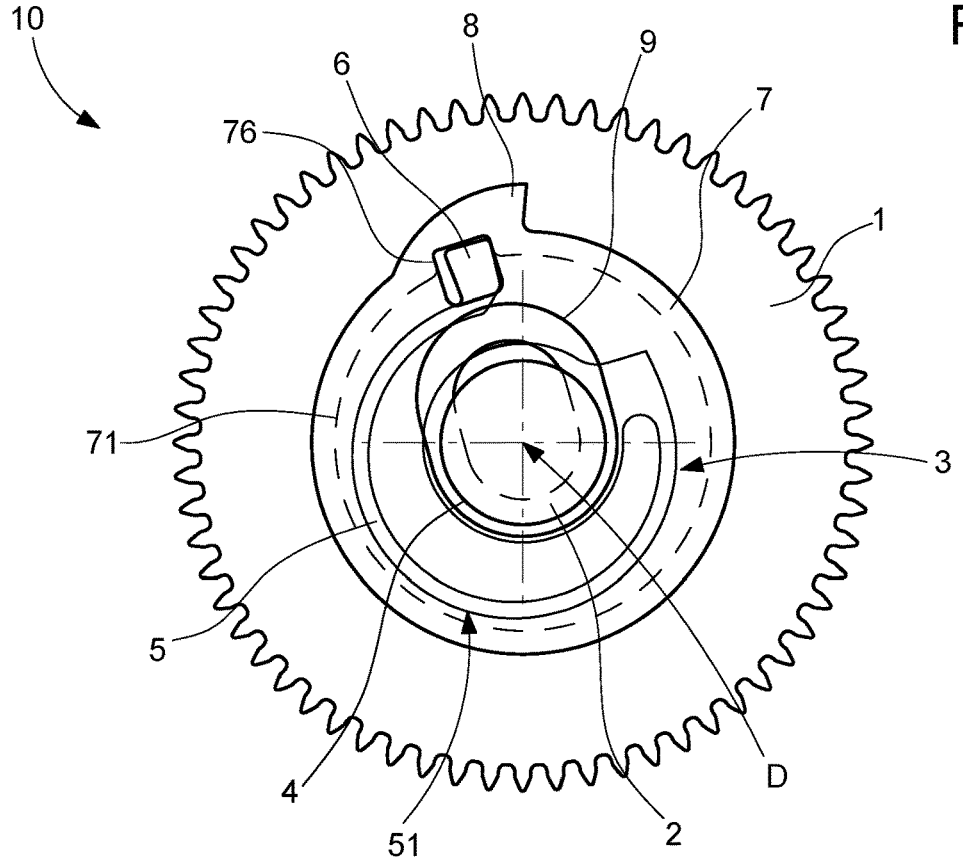
FIG. 1 shows, schematically, and in plan view, a timepiece mobile for a semi-instantaneous jump mechanism according to the invention, with a toothed wheel, a hub, and an inner part of a spiral spring integral with each other, a solid outer end of the spring being housed in a housing that a stop member includes, this stop member including an oblong groove allowing a radial travel of the hub with respect to the stop member, this mobile is shown in an intermediate position during the winding of the spring.
Figure 2:
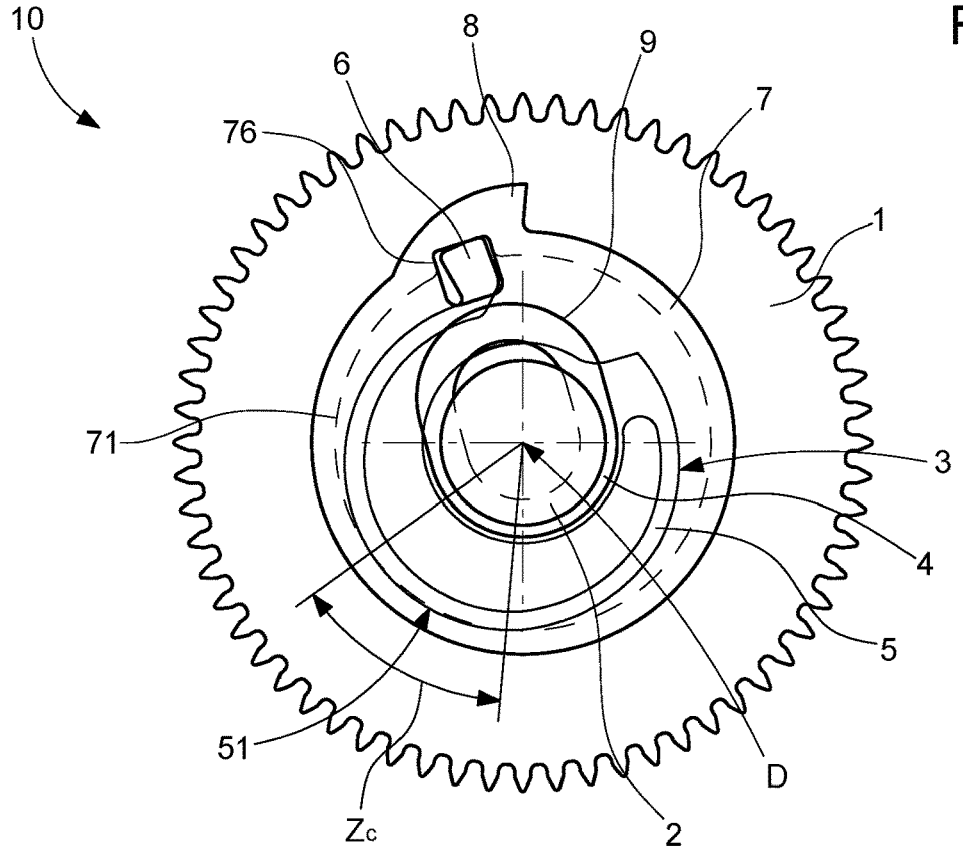
FIG. 2 shows, similarly to FIG. 1, the same mobile in a wound configuration, where the outer coil of the spring is in bearing contact, over a wide angular range, with a bore or recess or a counterbore that the stop member includes.
Figure 3:
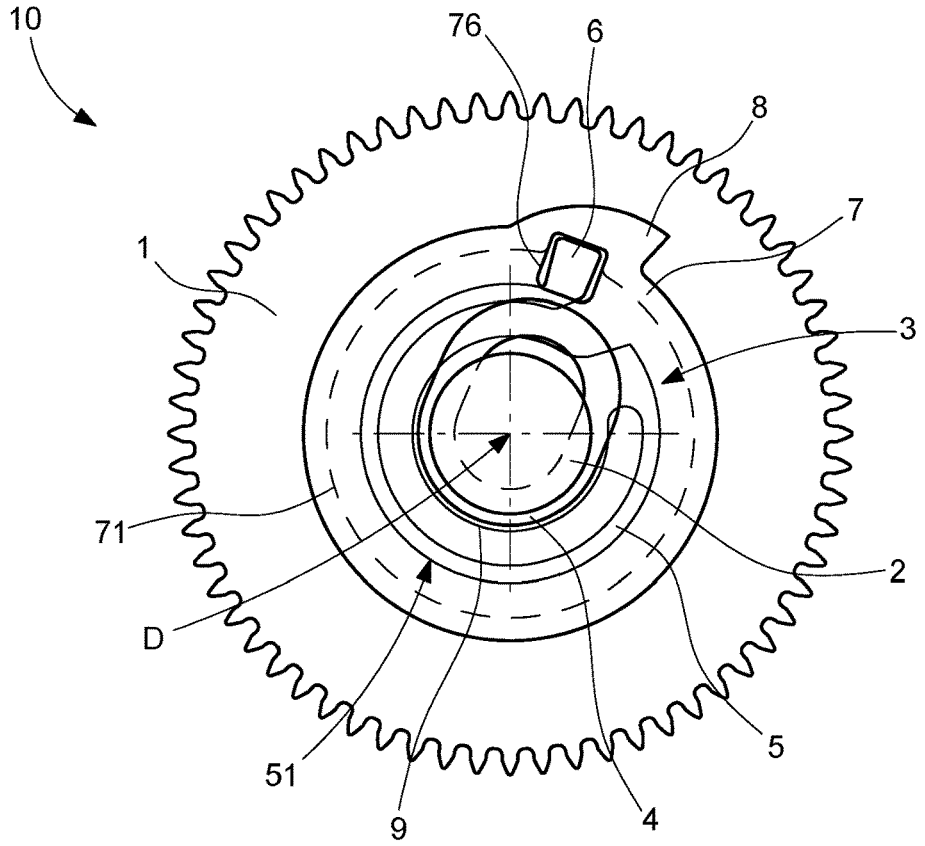
FIG. 3 shows, similarly to FIGS. 1 and 2, the same mobile in an unwound configuration, where the contact between the outer coil of the spring with this bore or recess or counterbore is reduced to a minimum or is zero.

The invention relates to a timepiece mobile 10 for a semi-instantaneous jump mechanism 100. This mobile 10 includes a stop member 7, an elastic return means 3, and a drive wheel 1 which includes, around a pivot axis D, a hub 2 for guiding the stop member 7.

This stop member 7 is movable with respect to the drive wheel 1, and includes at least one stop finger 8, which is disengageable and movable between a wound position wherein the radial extension of the stop finger 8 is maximum with respect to the axis D, and an unwound position wherein the radial extension of the stop finger 8 is minimal with respect to the axis D.

This stop finger 8 is subjected to the action of the elastic return means 3 which tends to move it away from the axis D, or constitutes a part of this elastic return means 3, conventionally in the shape of a finger-spring.

According to the invention, the stop member 7 includes a first housing 71, the walls of which are arranged to bearingly cooperate, during the winding of the elastic return means 3 with a contact surface 51 that the elastic return means 3 includes, to limit the value of the winding and to limit the deformation of the elastic return means 3 to its elastic range only. It is thus possible to prevent damage to this elastic return means 3, in particular during adjustment operations, as will be explained below.

The invention is illustrated in the figures by the particular case of a semi-instantaneous date drive wheel.

More particularly, the hub 2 is integral with the drive wheel 1.

More particularly, the elastic return means 3 is a spring, an inner end 4 of which is integral with the hub 2 and/or the drive wheel 1.

More particularly, the elastic return means 3 is a spring, an outer end 6 of which is housed in a second housing 76 that the stop member 7 includes. More particularly, this outer end 6 is loosely movable in the second housing 76.

More particularly, the elastic return means 3 is a spring which includes a coil 51, which is arranged to come into contact with the first housing 71 of the stop member 7 in the wound position according to a large contact area ZC of an angular amplitude greater than 10° with respect to the axis D, and to remain at a distance from the first housing 71 in the unwound position.

Preferably, this first housing 71 is formed by a bore, or a recess, or a counterbore, over at least one angular part capable of being in contact with the coil(s) of the spring. For example, the figures show a first housing 71 constituted by a recess over approximately 355°, and which is cleared over an angle at the centre of approximately 5° to allow the passage of the outer end of the spring 6 and its insertion into the second housing 76.

More particularly, the stop member 7 includes an oblong opening 9 wherein the hub 2 is housed and which allows radial mobility of the stop member 7 with respect to the hub 2 in order to modify the radial position of the peripheral stop finger 8 that the stop member 7 includes.

The invention also relates to a semi-instantaneous jump timepiece display mechanism 100 including such a mobile 10. More particularly, this mechanism 100 includes drive means for driving the drive wheel 1, and at least one display mobile 110 which includes a toothing 108 arranged to cooperate with the stop finger 8 of the mobile 10, or a profile including reliefs capable of cooperating with this stop finger 8.

More particularly, this mechanism 100 is a date mechanism.

Figure 4:
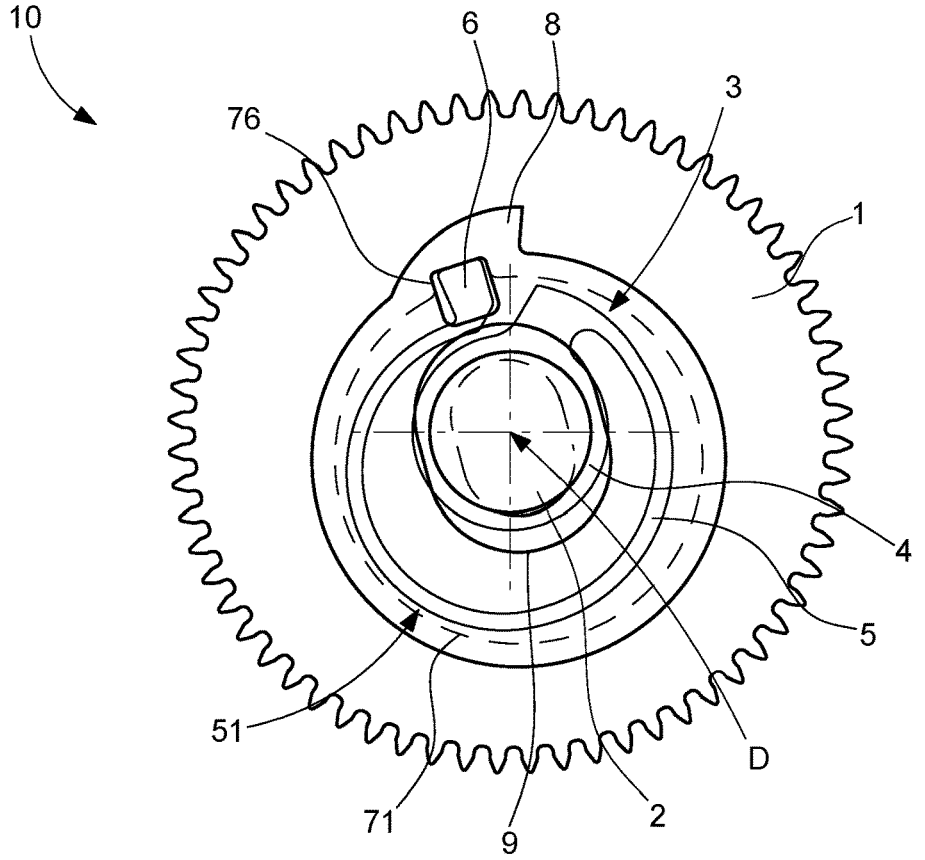
FIG. 4 shows, similarly to FIGS. 1 and 2, the same mobile in an unwound configuration, where the contact between the outer coil of the spring with this bore or recess or counterbore is reduced to a minimum or is zero, and where the hub has changed its relative position with respect to the stop member, by sliding in the oblong groove thereof, this configuration occurring when another mobile of a display mechanism radially pushes the finger of the stop member towards the centre during an adjustment handling, such as for example a date indicator visible below in FIG. 7.
Figure 5:
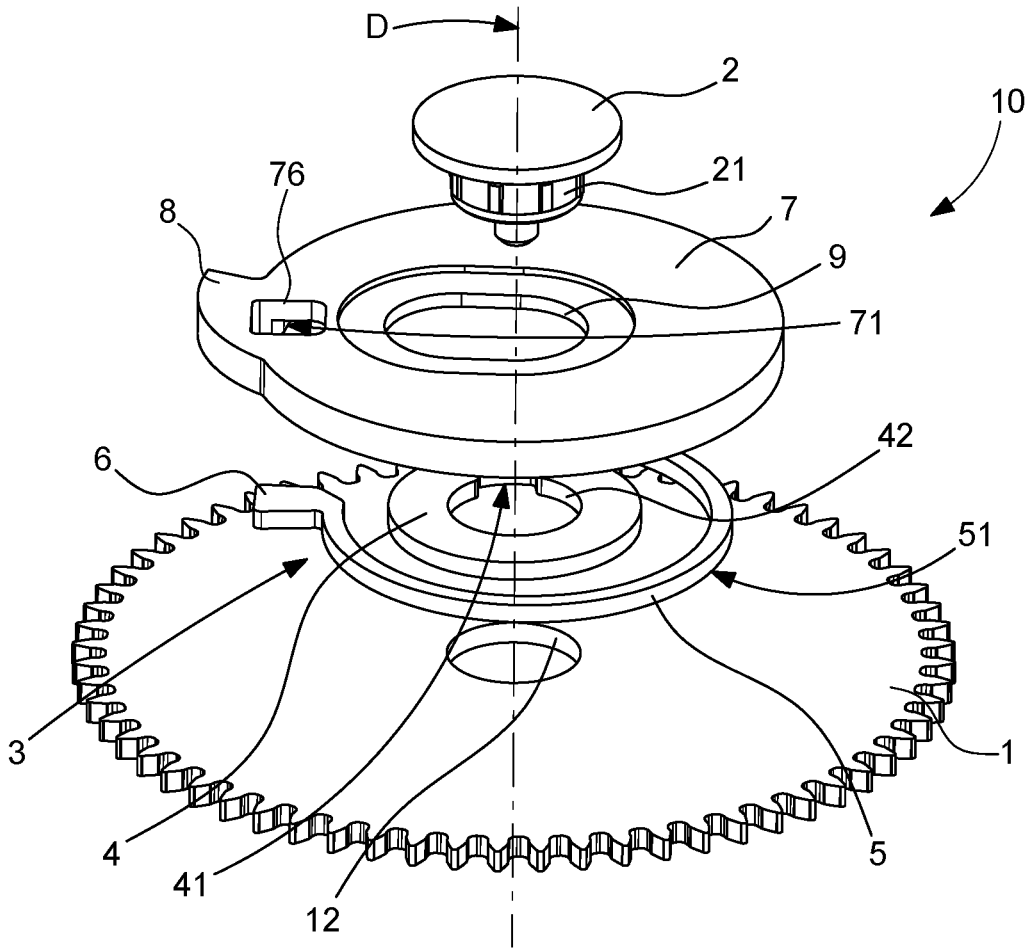
FIG. 5 shows, schematically, and in exploded perspective, the mobile of FIGS. 1 to 4.
Figure 6:
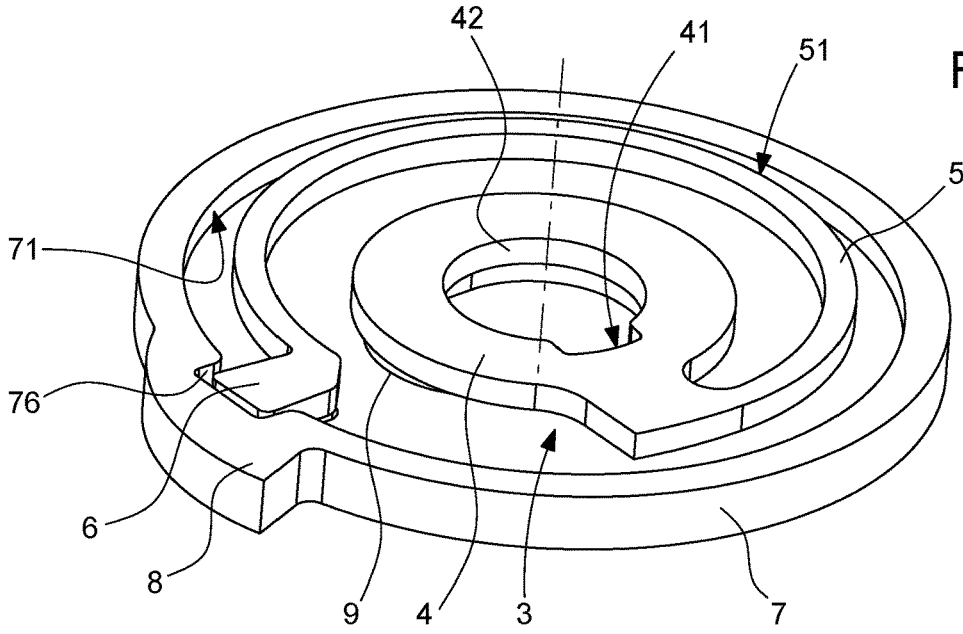
FIG. 6 shows, schematically, and in perspective, the cooperation of the stop member and the spring of the mobile of FIGS. 1 to 3.
Figure 7:
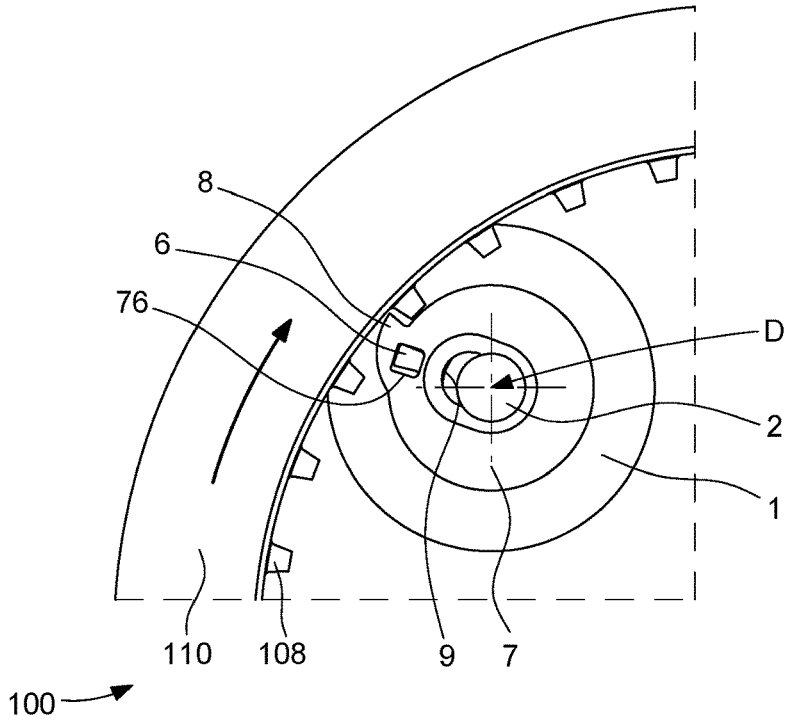
FIG. 7 shows, schematically, partially, and in plan view, a timepiece display mechanism with semi-instantaneous jump, which is a date mechanism including a display mobile, which includes a toothing arranged to cooperate with the stop finger of the mobile of FIGS. 1 to 5.
Figure 8:
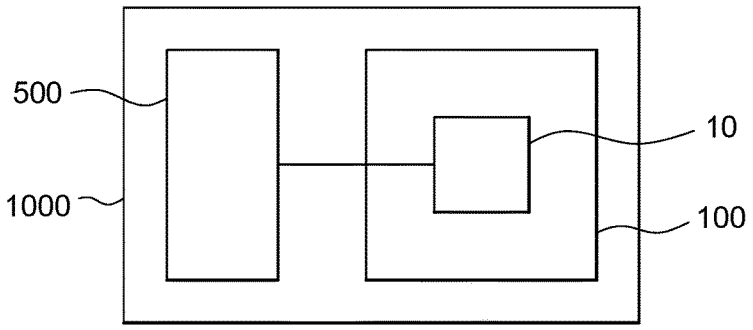
FIG. 8 is a block diagram showing a timepiece, in particular a watch, including at least one such semi-instantaneous jump timepiece display mechanism.

FIG. 7 shows this particular and non-limiting case of a date mechanism. During a date correction by the user, a tooth 108 of the date indicator 110, rotating in the clockwise direction of the arrow in this figure, would push the finger 8, thus controlling the disengagement and the relative change of position of the hub 2 with respect to the oblong 9 during the radial withdrawal of the finger 8 under the pushing action exerted by a tooth 108, as can be seen in FIG. 4; after the passage of the tooth 108, the spring 3 returns the finger 8 to the position shown in FIG. 7; this finger 8 will drive a tooth 108 during the next date change.

The invention also relates to a timepiece 1000 including at least one such semi-instantaneous jump timepiece display mechanism 100, particularly with control means 500. More particularly, this timepiece 1000 is a watch.

In sum, the invention allows to secure a fragile mechanism, because it reduces the risk of breakage of the spring elements since the abutment is made on a large bearing area of the spring, while providing a significant gain in the space requirement compared to existing mechanisms. Maintaining the elastic properties of the spring is guaranteed. The invention guarantees better control of forces. The mechanism according to the invention stores energy in a controlled manner, with precise angular winding.

The invention claimed is:

1. A timepiece mobile for a semi-instantaneous jump mechanism, said mobile including a stop member, an elastic return means, and a drive wheel which includes, around a pivot axis, a hub for guiding said stop member, which stop member is movable with respect to said drive wheel and includes at least one disengageable stop finger movable between a wound position wherein the radial extension of said stop finger is maximum with respect to said axis, and an unwound position wherein the radial extension of said stop finger is minimal with respect to said axis, said stop finger being subjected to the action of said elastic return means which tends to move it away from said axis, wherein said stop member includes a first housing the walls of which are arranged to bearingly cooperate, during the winding of said elastic return means with a contact surface, wherein said elastic return means includes means to limit the value of said winding and to limit the deformation of said elastic return means to its elastic range only.

2. The mobile according to claim 1, wherein said hub is integral with said drive wheel.

3. The mobile according to claim 1, wherein said elastic return means is a spring, an inner end of which is integral with said hub and/or said drive wheel.

4. The mobile according to claim 1, wherein said elastic return means is a spring, an outer end of which is housed in a second housing that said stop member includes.

5. The mobile according to claim 4, wherein said outer end is loosely movable in said second housing.

6. The mobile according to claim 4, wherein said spring includes a coil arranged to come into contact with said first housing of said stop member in said wound position according to a large contact area of an angular amplitude greater than 10° with respect to said axis, and to remain at a distance from said first housing in said unwound position.

7. The mobile according to claim 1, wherein said stop member includes an oblong opening wherein said hub is housed and which allows radial mobility of said stop member with respect to said hub in order to modify the radial position of said peripheral stop finger that said stop member includes.

8. A semi-instantaneous jump timepiece display mechanism including a mobile according to claim 1, drive means for driving said drive wheel, a display mobile which includes a toothing arranged to cooperate with said stop finger of said mobile.

9. The semi-instantaneous jump timepiece display mechanism according to claim 8, wherein said mechanism is a date mechanism.

10. A timepiece including at least one semi-instantaneous jump timepiece display mechanism according to claim 8.

11. The timepiece according to claim 10, wherein said timepiece is a watch.

* * * * *